United States Patent [19]

Alton

[11] Patent Number: 4,955,485

[45] Date of Patent: Sep. 11, 1990

[54] DISPLAY DEVICE

[76] Inventor: Forrest W. Alton, 24503 E. 111th, Broken Arrow, Okla. 74014

[21] Appl. No.: 291,963

[22] Filed: Dec. 30, 1988

[51] Int. Cl.[5] ..... A47F 7/00

[52] U.S. Cl. ..... 211/14; 211/188; 211/189

[58] Field of Search ..... 211/14, 189, 194, 186, 211/188, 163, 144, 150

[56] References Cited

U.S. PATENT DOCUMENTS

| | | | |
|---|---|---|---|
| 1,645,399 | 10/1927 | Pontikis . | |
| 1,998,490 | 4/1935 | Carrm | 211/158 |
| 2,649,969 | 8/1953 | Andrews | 211/71 |
| 3,279,619 | 10/1966 | Alissandratos | 211/71 |
| 3,695,458 | 10/1972 | Nagel | 211/177 |
| 3,951,080 | 4/1976 | Roberts | 211/186 X |
| 4,093,076 | 6/1978 | Newton | 211/74 |
| 4,095,698 | 6/1978 | Wright | 211/126 |
| 4,123,128 | 10/1978 | Abele | 312/244 |
| 4,444,321 | 4/1984 | Carlstrom | 211/186 |
| 4,847,461 | 7/1989 | Gilmore | 211/188 X |

*Primary Examiner*—Blair M. Johnson

[57] ABSTRACT

An improved display device for organizing, storing and displaying a series of collectibles (for example, autographed baseballs) or the like comprising a series of stacked shelves wherein each shelf is made up of a series of circular disc elements that reversibly engage and disengage to adjacent center shelf elements and/or end shelf elements such that the entire display device pivots about the center axis of the stack of disc elements. In this manner, a structurally stable display device that can be configured in a variety of positions and can be expanded as the number of items being displayed increase is produced.

5 Claims, 5 Drawing Sheets

DISPLAY DEVICE

BACKGROUND OF THE INVENTION

1. Field of the Invention

This invention relates to a display device for organizing and storing collectibles. More specifically, the invention relates to a modular display device that in a free standing configuration can be bent through various angles and also expanded vertically and horizontally at will.

2. Description of the Prior Art

It is generally known and a common practice to display a set or collection of items in various ways using a variety of display devices. Thus, it is generally known to display collectibles on shelves such as the common knick-knack shelf. It is also generally known in the case of displaying a collection of autographed baseballs to place the baseball on a small pedestal or stand. However, prior to the present invention, there was no convenient display device that would hold and display a collection of autographed baseballs on pedestals wherein the display device was modular thus capable of being expanded as the collection grows as well as being sufficiently versatile to conform to various overall configurations, geometries and spacial arrangements.

SUMMARY OF THE INVENTION

In view of the problems associated with the prior art display devices, the present invention provides a modular display unit that involves individual storage cells arranged in a shelf like structure. According to the present invention, the individual cells are readily assembled or disassembled allowing the overall display device to be expanded as circumstance and requirements dictate. Because of the nature of the structural elements involved in the individual modular cells, the entire display device can be bent about the vertical center line of each stack of individual cells, thus allowing the display device to conform to various shapes and configurations, again as dictated by the specific end use requirements.

Thus, the present invention provides a display device comprising:

(a) a plurality of circular disc means for engaging adjacent center shelf means and end shelf means such that the assembly forms a display shelf;

(b) a plurality of center shelf means for slidably engaging to adjacent disc means such as to be adapted to pivot about the center of the adjacent disc means;

(c) a plurality of end shelf means for slidably engaging to adjacent disc means such as to be adapted to pivot about the center of the adjacent disc means; and (d) a plurality of vertical structural means for engaging the top of a first assembly of circular disc means, center shelf means and end shelf means forming a lower display shelf and for engaging the bottom of a second assembly of circular disc means, center shelf means, and end shelf means forming an upper display shelf thus supporting the second upper display shelf.

It is an object of the present invention to provide a display device for storing and organizing various items and in particular, storing and displaying collectibles. It is a further object of the present invention to provide a display device that is modular in concept in that the device can be readily expanded as the collection of items being stored and displayed increases. And it is a further object of the present invention to provide a display device that is versatile in that it can be assembled and arranged such as to conform to a variety of special configurations. Fulfillment of these objects and the presence and fulfillment of other objects will be apparent upon complete reading of the specification and claims taken in conjunction with the attached drawings.

DESCRIPTION OF THE PREFERRED EMBODIMENTS

Figure 1:
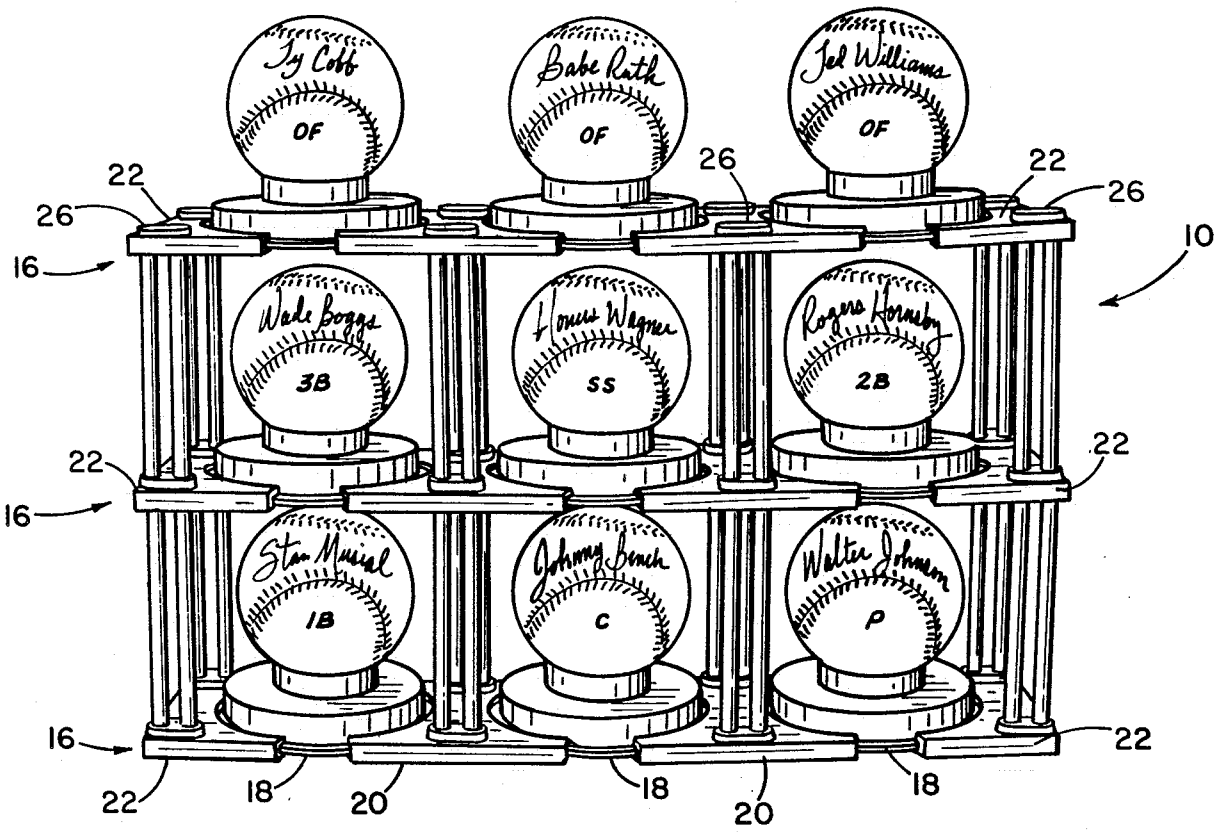
FIG. 1 represents a perspective view of one preferred embodiment of the display device according to the present invention while displaying a collection of autographed baseballs.

The novel display device according to the present invention, how it functions and how it differs from previously known display devices, as well as the advantages and benefits associated with its use, can perhaps be best explained and understood by reference to the drawings. FIG. 1 illustrates one particularly preferred embodiment of the display device according to the present invention, generally designated by the numeral 10, with baseballs 12 resting on pedestals 14 shown in silhouette (not part of the invention). As such, the present invention should be viewed as being generally useful in displaying various types of items, articles, collectibles and the like.

As further illustrated in FIG. 1, the multilevel display device 10 is primarily made up of only four different types of structural elements. These elements are reversibly assembled/disassembled, thus forming an endless variety of configurations capable of storing and displaying the items. More specifically, the horizontal shelves 16 are assembled from a series of flat circular disc elements 18 with a pair of either center pieces 20 or end pieces 22 or one of each on opposite sides of disc elements 18. Between each horizontal shelf are a series of vertical structural elements 24 that interconnect and rest on the lower shelf and support the upper shelf. In this particular embodiment, there are a pair of vertical structural elements 24 for each center piece 20 and each end piece 22. The openings on the top surface of the display device 10 intended for accepting further vertical elements for the next layer or shelf are provided with optional cap members 26, lending to the aesthetic of the display device, but not structural in nature.

Figure 2:
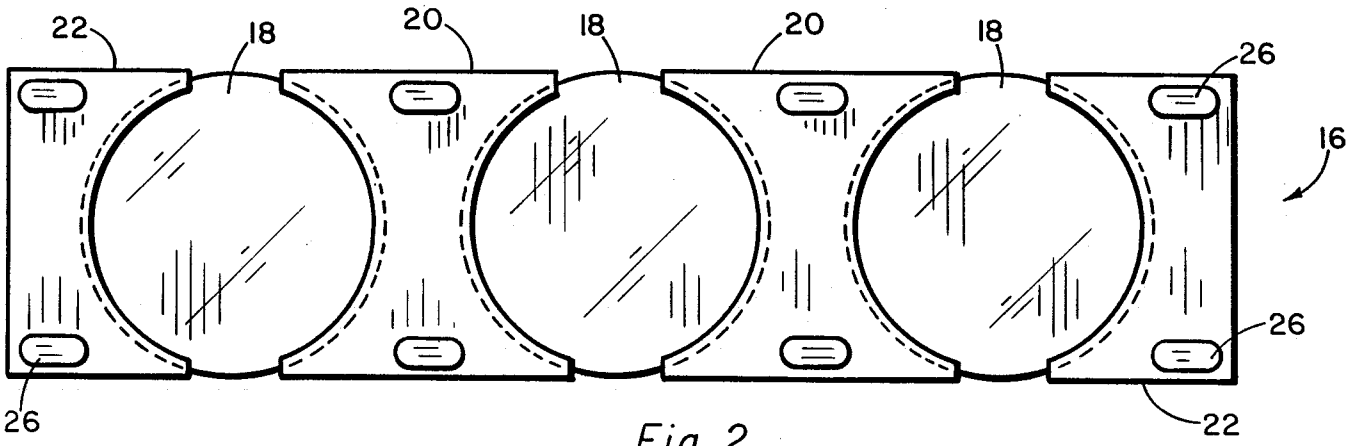
FIG. 2 is a top view of the display device of FIG. 1 without the baseballs illustrating how the component parts interconnect in an adjustable fashion.
Figure 4:
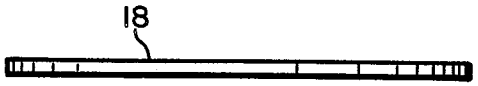
FIG. 4 is a side elevational view of the disc shelf element of FIG. 3.
Figure 3:
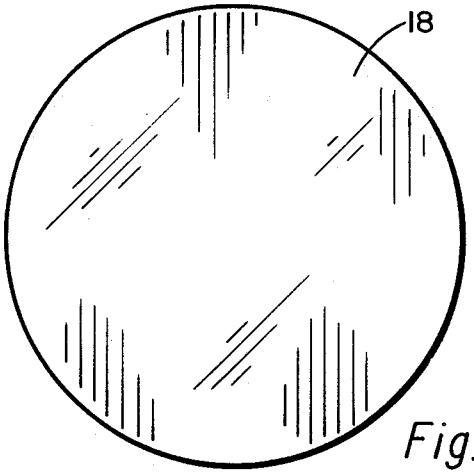
FIG. 3 is a top and bottom view of the disc shelf element of the display device of FIG. 2.
Figure 5:
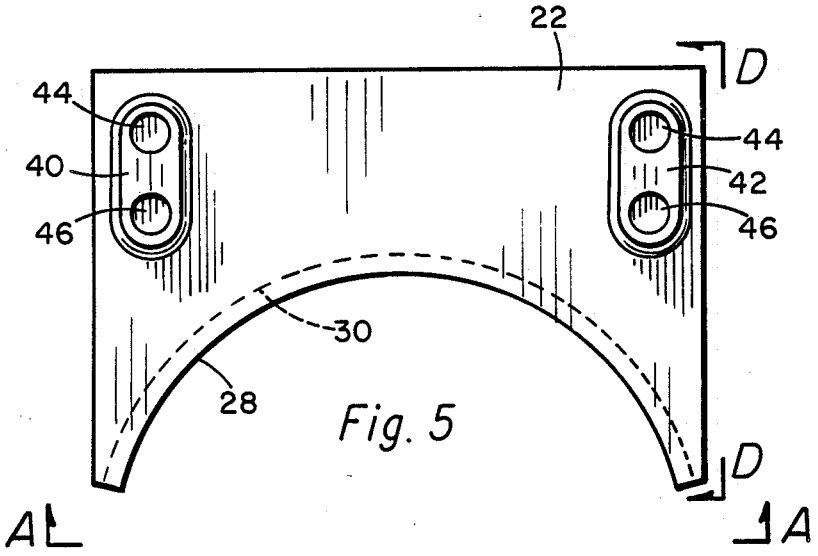
FIG. 5 is a top plan view of the end shelf element of the display device of FIG. 2.
Figure 6:
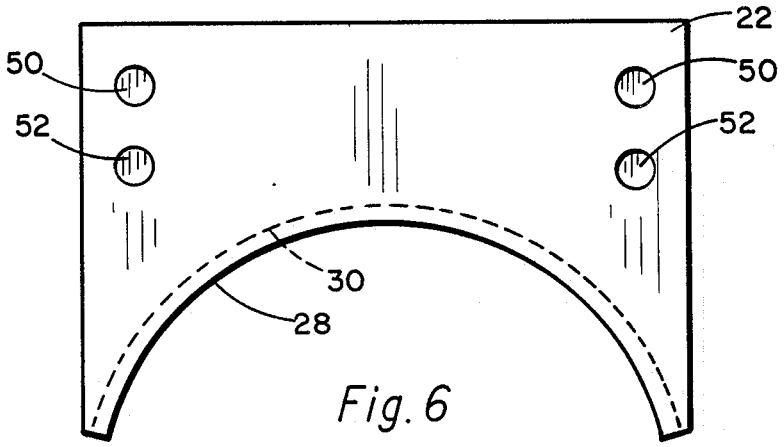
FIG. 6 is a bottom view of the end shelf element of FIG. 5.
Figure 10:
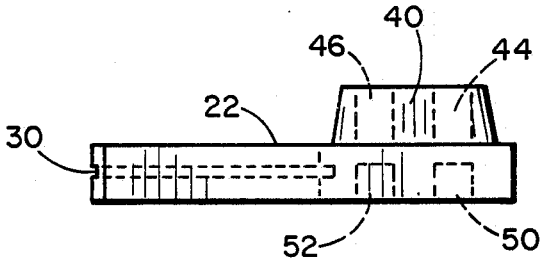
FIG. 10 is a side elevational view of the end shelf element of FIG. 5 as seen through line D—D.
Figure 9:
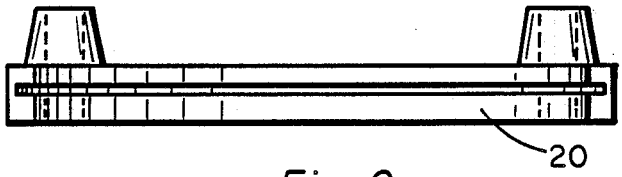
FIG. 9 is a side elevational view of the end shelf element of FIG. 5 as seen through line A—A and side elevational view of the center shelf element of FIG. 7 as seen through line B—B and line C—C.
Figure 7:
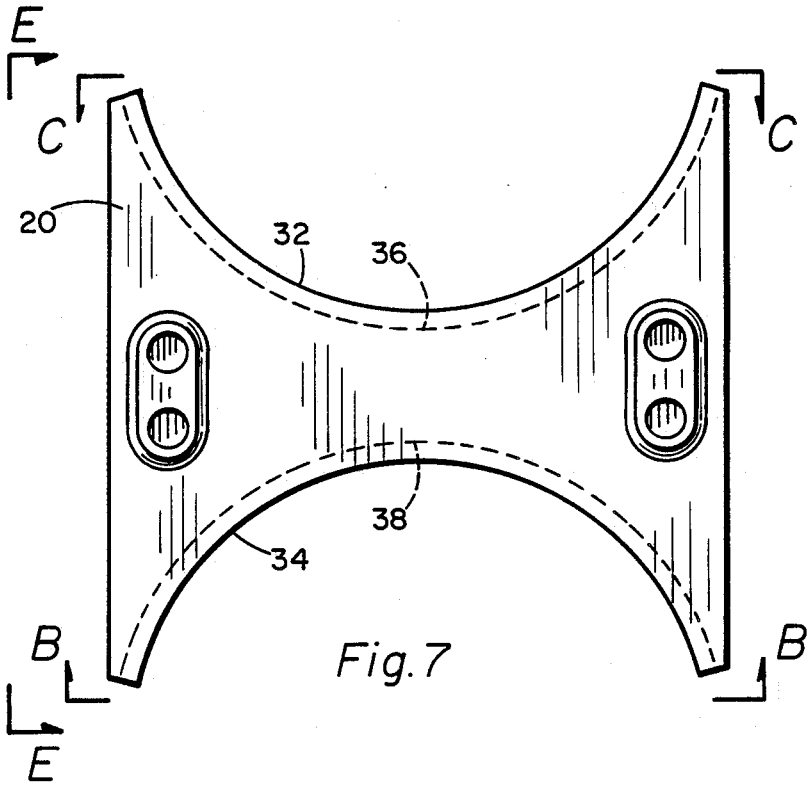
FIG. 7 is a top plan view of the center shelf element of the display device of FIG. 2.
Figure 11:
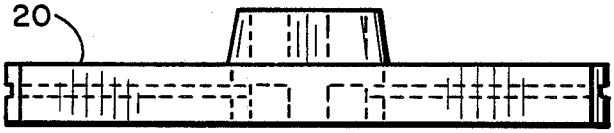
FIG. 11 is a side elevational view of the center shelf element of FIG. 7 as seen through line E—E.
Figure 8:
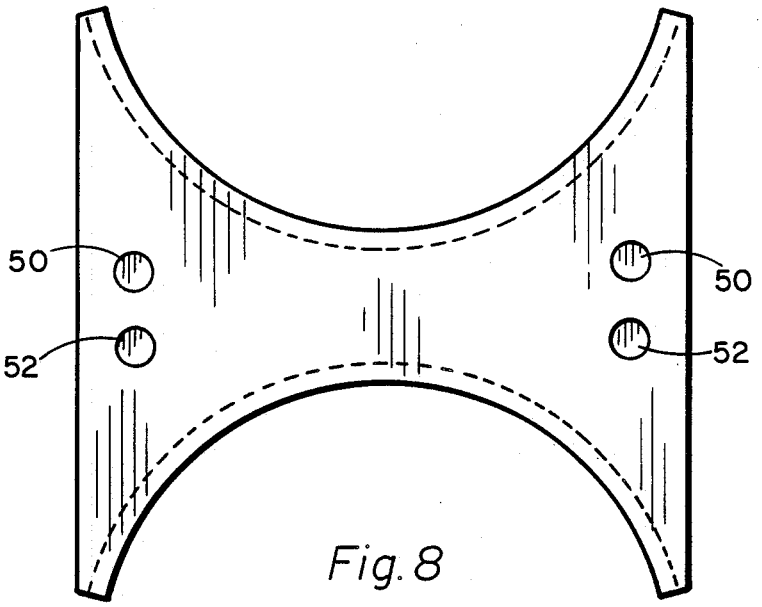
FIG. 8 is a bottom view of the center shelf element of FIG. 7.

As illustrated in FIG. 2, the disc elements 18 on each respective shelf are displaced directly on top of each other such that they have a common central axis of rotation. As seen in FIGS. 5 and 10, the end piece 22 has a semi-circular edge 28 with a groove 30 positioned in the middle of the semi-circular edge. As seen in FIGS. 3 and 4, the disc element 18 is sized to insert and rotatably slide within the groove 30. Similarly, as seen in FIGS. 7 and 11, the center pieces 20 have a pair of semi-circular edges 32 and 34 on opposite sides of the center pieces 20 with each semi-circular edge having a groove 36 and 38, respectively. As suggested by the radius of curvature and center of rotation of the semi-circular edge of FIG. 5, the semi-circular edges and grooves are intentionally less than half circles in this particular embodiment approximately 150°. of arc. Because of the less than half circle nature of the curved edges and grooves, the entire display device can be rotated about the central axis of the stack of disc elements 18 such that the display device turns a corner or is bent through, in this embodiment, up to 30 degrees (see FIG. 2). It should be appreciated that the grooves as well as the circular edge of the disc elements can be either tapered such as to make a compressive wedged fit during assembly or provided with a reverse taper such as to snap together thus facilitating structural integrity of the shelves.

Figure 12:
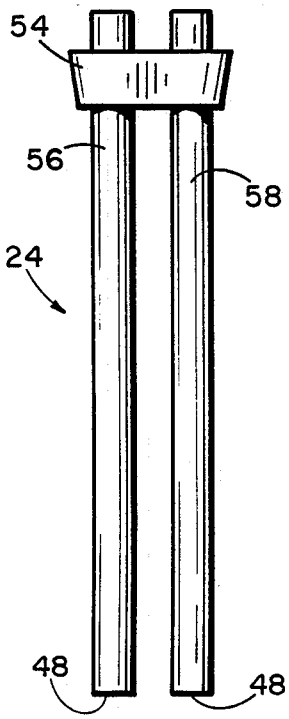
FIG. 12 is a front view of the vertical shelf spacer element of the display device of FIG. 2.
Figure 13:
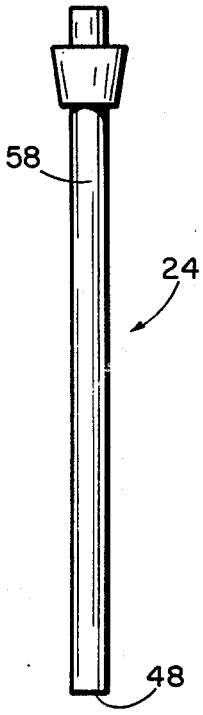
FIG. 13 is a side view of the vertical shelf spacer element of FIG. 12.
Figure 14:
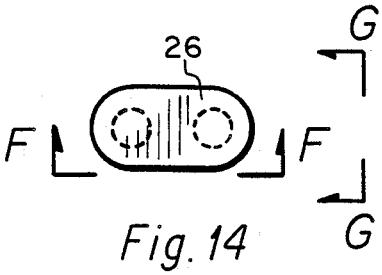
FIG. 14 is a top plan view of the shelf spacer end cap of the display device of FIG. 2.
Figure 15:
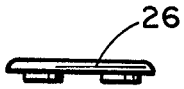
FIG. 15 is a side view of the end cap of FIG. 14 as seen through line F—F.
Figure 16:
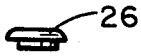
FIG. 16 is a side view of the end cap of FIG. 14 as seen through line G—G.

As further seen in FIGS. 5 through 11, the top of the center shelf pieces 20 and end shelf pieces 22 are equipped with protrusions 40 and 42, respectively, each with a pair of circular holes 44 and 46 that receive and hold the lower ends 48 of vertical support elements 24 (see FIGS. 12 and 13). The bottom side of center shelf pieces 20 and end shelf pieces 22 have openings 50 and 52, respectively, for receiving and holding the top portion of vertical support elements 24 (again, see FIGS. 12 and 13). The vertical element 24 also has a bridge element 54, similar in appearance to the protrusions 50, at the top of the pair of cylindrical columns 56 and 58, producing a symmetrical appearance above and below the shelves. As a finishing touch, the end cap 26 as shown in FIGS. 14, 15 and 16 are provided to insert into the openings of protrusions 40 exposed on the top of the display device. Because of the presence of multiple vertical support elements for each end piece and center piece and the presence of the circular disc and semi-circular groove configuration, the display device when assembled takes on a stiffness and rigidity that stabilizes the structure, yet the presence of the circular disc in the semi-circular grooves allows the structure to be bent. The fact that the device is assembled out of a series of repeating structural elements allows the user to build the display device into arbitrarily any size that meets the particular end use requirements. As such, one could readily use the present invention to display a collection of items, for example, autographed baseballs or the like as shown in FIG. 1, and as the collection grows, increase the number of storage/display cells by merely adding the appropriate pieces.

It should be appreciated that the specific design, orientation and appearance of the display device can be altered by changing the relative size, shape and appearance of the individual elements without departing from the scope and essence of the present invention. For example, end pieces 20 can be used internally along a given shelf 16, thus creating a storage/display cell twice as tall as the normal cell. Also, other geometric center pieces with more than two semi-circular edges and grooves can be employed to create branch points within the overall display device. Thus, a triangular center piece with three semi-circular grooved edges or a pentagon with five or the like can be provided to form a more complex display structure. Similarly, the size of individual structural elements can vary according to the type and size of collectibles or other items to be displayed. Thus, the display device according to the present invention can be designed and manufactured to accommodate small objects such as coins, thimbles or the like or easily scaled up to a free standing display shelf for museum pieces or the like.

The actual manufacturing of the elements making up the display device according to the present invention can be out of any of the common structural material and by any of the well known fabrication techniques as generally known in the art. Preferably, the individual pieces are molded out of plastic. Most preferably, the pieces are injection molded out of a thermoplastic such as impact polystyrene while the disc element is most preferably transparent crystal polystyrene, however, other thermoplastics such as, for example, ABS, polycarbonates, polyolefins, acrylics, as well as fiber reinforced thermoplastic and the like can be readily employed to manufacture the display device.

Having thus described the invention with a certain degree of particularity, it is to be understood that the invention is not limited to the embodiments set forth herein for purposes of exemplification, but is to be limited only by the scope of the attached claims, including a full range of equivalents to which each element thereof is entitled.

I claim:

1. A display device comprising:

(a) a plurality of circular disc means for engaging adjacent center shelf means and end shelf means such that the assembly forms a display shelf;

(b) a plurality of center shelf means slidably engaging adjacent circular disc means such as to pivot about the center of said adjacent circular disc means;

(c) a plurality of end shelf means slidably engaging adjacent circular disc means such as to pivot about the center of said adjacent circular disc means; and (d) a plurality of vertical structural means engaging the top of a first assembly of circular disc means, center shelf means and end shelf means forming a lower display shelf and engaging the bottom of a second assembly of circular disc means, center shelf means, and end shelf means forming an upper display shelf thus supporting the second upper display shelf, whereby the display shelves may be pivoted about said center shelf means so that the display device can be adjusted to form various arrangements.

2. A display device of claim 1 wherein said circular disc means engages to said adjacent center shelf means or said end shelf means by inserting into a groove in a semi-circular edge of said adjacent center shelf means or said end shelf means.

3. A display device of claim 1 wherein said circular disc means engages to said adjacent center shelf means or said end shelf means by inserting into a groove in a semi-circular edge of said adjacent center shelf means or said end shelf means.

4. A display device of claim 3 wherein the semi-circular edge and groove of said center shelf means and of said end shelf means span a circular arc of about 150° thus allowing the display device to bend through an angle up to about 30 ° at each vertical stack of circular disc means.

5. A display device comprising:

(a) a plurality of circular disc means for engaging adjacent center shelf means and end shelf means such that the assembly forms a display shelf;

(b) a plurality of center shelf means slidably engaging adjacent circular disc means such as pivot about the center of said adjacent circular disc means;

(c) a plurality of end shelf means slidably engaging adjacent circular disc means such as to be adapted to pivot about the center of said adjacent circular disc means; and (d) a plurality of vertical structural means engaging the top of a first assembly of circular disc means, center shelf means and end shelf means forming a lower display shelf and engaging the bottom of a second assembly of circular disc means, center shelf means, and end shelf means forming an upper display shelf thus supporting the second upper display shelf above the lower display shelf as successive display shelves whereby the display shelves may be pivoted about said center shelf means so that the display device can be adjusted to form various arrangements.

* * * * *